US005636743A

United States Patent [19]

Dalbo

[11] Patent Number: 5,636,743

[45] Date of Patent: Jun. 10, 1997

[54] BEAD TRAY

[75] Inventor: Emil J. Dalbo, Tucker, Ga.

[73] Assignee: Dal-Craft, Inc., Tucker, Ga.

[21] Appl. No.: 225,749

[22] Filed: Apr. 11, 1994

[51] Int. Cl.[6] ..... B65D 1/34; B65D 6/04; A45C 11/04

[52] U.S. Cl. ..... 206/564; 206/566; 206/6.1; 220/524; 220/555

[58] Field of Search ..... 206/6.1, 563, 564, 206/566, 443, 528, 534.2, 538, 540; 220/524, 555, 575; 222/572, 462

[56] References Cited

U.S. PATENT DOCUMENTS

| | | | |
|---|---|---|---|
| 508,700 | 11/1893 | Gruebel | 206/564 |
| 2,333,587 | 11/1943 | Salfisberg | 206/534.2 |
| 2,491,771 | 12/1949 | Roos | 206/564 |
| 2,774,466 | 12/1956 | Liska | 220/555 |
| 3,343,709 | 9/1967 | Henderson | 206/534.2 |
| 3,406,821 | 10/1968 | Weissberg | 206/563 |
| 4,034,885 | 7/1977 | Hunckler et al. | 220/524 |
| 4,253,572 | 3/1981 | Halbich | 220/524 |
| 4,502,612 | 3/1985 | Morrison | 206/540 |
| 4,593,819 | 6/1986 | Will | 206/538 |
| 4,741,441 | 5/1988 | Keffeler | 220/524 |
| 5,046,616 | 9/1991 | Makowski et al. | 206/564 |

*Primary Examiner*—M. D. Patterson
*Attorney, Agent, or Firm*—James B. Middleton

[57] ABSTRACT

A tray for temporarily or permanently receiving beads for bead work has a plurality of separate compartments, each with a separate cover. A single sheet of material can be vacuum formed to create the compartments, and the covers can also be vacuum formed. A rib on the covers is received within the compartments and frictionally engages the side walls to hold the covers in place. One end of each compartment has angled walls to provide a funnel arrangement, leading to a pour spout, and an upwardly ramped bottom portion directs beads to the spout. The cover can be reversed and used to prevent spilling of beads during pouring. The tray can also define one of more design grooves for laying out the pattern of beads.

7 Claims, 1 Drawing Sheet

BEAD TRAY

BACKGROUND OF THE INVENTION

1. Field of the Invention

This invention relates generally to containers for handicraft items or the like, and is more particularly concerned with a shallow tray for receiving beads for bead work.

2. Discussion of the Prior Art

People who do bead work typically use a variety of beads, the beads being of many different colors, sizes and textures. The beads are purchased in a container that the bead worker utilizes as permanent storage; but, the beads must be placed in another container, at least temporarily, to provide access to the beads during work on a particular project. The most common type of container used by bead workers is simply a generally flat, shallow tray.

The conventional trays used by bead workers allow access to the beads being used, but there are some great disadvantages. In the first place, one must use a plurality of the separate trays when one is using a plurality of beads for a given project. Each tray is of course subject to being tipped, thereby spilling the beads. Those skilled in the art will realize that many of the beads used by bead workers are so small that it is impracticable to retrieve the beads when spilled. Rather, one simply cleans up with a vacuum cleaner or the like, sacrificing the spilled beads. While larger beads may be retrieved, it is a difficult and time consuming task that is preferably avoided. Next, it will be realized that the trays are open, and one cannot work on top of the trays, so the trays must be set aside when not in use to prevent spilling. In addition, when a tray is to be emptied and the beads returned to a storage container, it is difficult to control the flow of beads from the tray and, again, there may be considerable spillage.

SUMMARY OF THE INVENTION

The present invention provides a tray for beads, the tray preferably having a plurality of compartments for receiving a plurality of different beads. The tray is shallow, and shaped for rigidity and convenience in use. One end of each compartment defines a pour spout so beads can conveniently be poured into a storage container. Furthermore, each compartment preferably includes a separate cover for closing the compartment. The cover is sufficiently secure that all but one compartment can be covered, and beads can be safely poured from the one open compartment while beads are retained in the others. When the covers are received on the compartments the top of the tray defines a generally flat surface that may be convenient for working on a project. It will therefore be understood that one might have one or two compartments open to provide access to some beads, and the person may use the rest of the tray as a work surface for the project.

In one preferred form of the invention, the tray further defines at least one design groove adjacent to the plurality of compartments.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE EMBODIMENT

Figure 1:
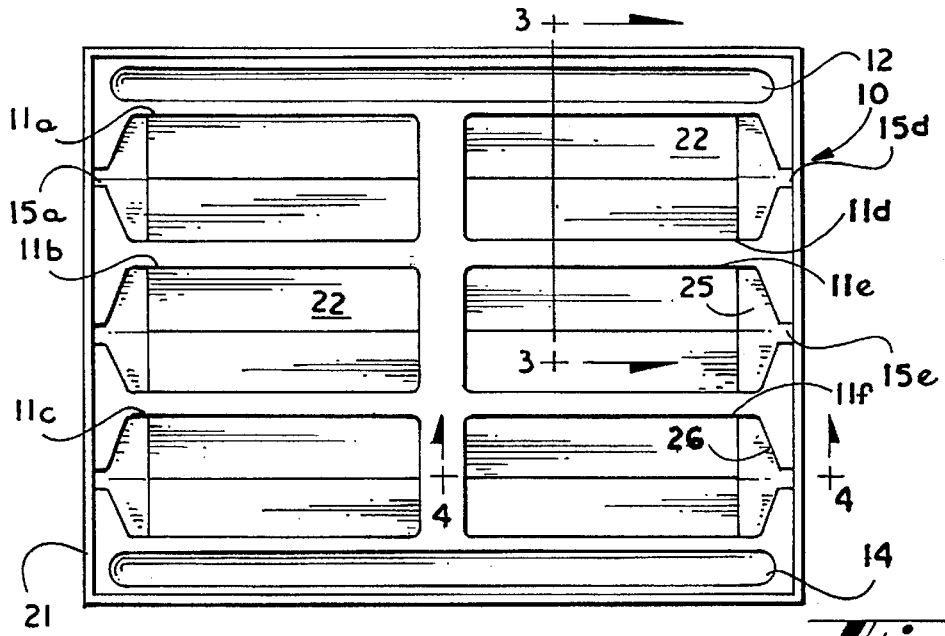
FIG. 1 is a top plan view of one form of tray made in accordance with the present invention, the covers being omitted to show the details of the tray.

Referring now more particularly to the drawings, and to that embodiment of the invention here presented by way of illustration, FIG. 1 shows a tray generally designated at 10 and having a plurality of compartments designated at 11*a*–11*f*. Since all the compartments are substantially alike, the compartments may be referred to generally by the numeral 11. In the embodiment of the invention here presented, there are six compartments 11, and there are two design grooves 12 and 14. The layout of the compartments 11 and the design grooves 12 and 14 as shown in FIG. 1 is thought to be practicable and convenient, both for use and for manufacture; however, those skilled in the art will realize that the tray may be rearranged as desired. For example, the compartments may be further spaced, and one or more additional design grooves can be provided between the compartments. Such an arrangement may be desirable if the tray is made much larger, with a larger number of compartments.

Each compartment shown in FIG. 1 defines a pour spout 15*a*–15*f* in one side, while all other sides of the compartment are formed by generally straight walls. The pour spout 15 will be discussed in more detail hereinafter. Considering the tray 10 as a whole, it will now be noticed that the tray 10 is generally rectangular, and two of the sides have the design grooves 12 and 14 adjacent thereto, while the other two sides have the pour spouts 15 adjacent thereto. As a result, the design grooves do not interfere with the use of the pour spouts.

Figure 2:
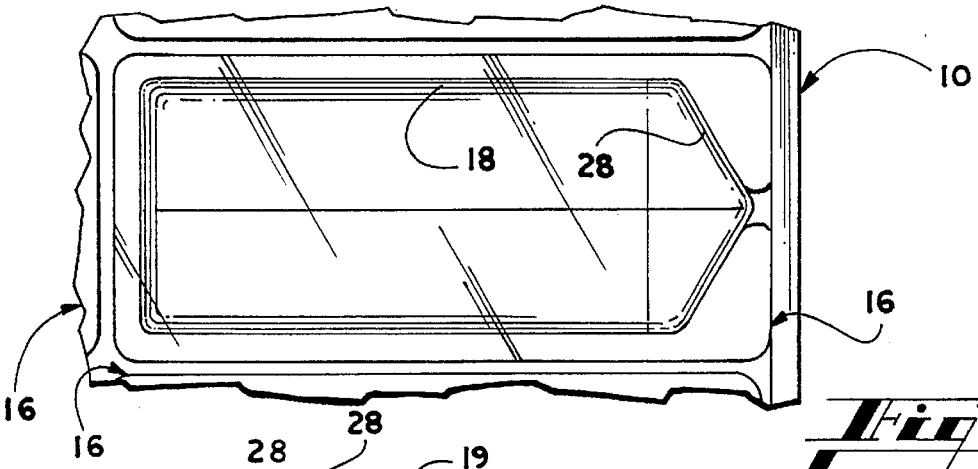
FIG. 2 is an enlarged top plan view of one of the compartments of the tray of FIG. 1, and having a cover thereon.

Looking briefly at FIG. 2 of the drawings, it will be seen that a cover 16 is received on the compartment 11*e*. The cover 16 includes a rib 18 that enters the compartment and frictionally engages the walls of the compartment. The cover 16 has a generally pentagonal shape to conform to the compartment that is generally rectangular but with a triangular end providing a pour spout. The construction of the cover 16 will be better understood from a discussion of FIGS. 3 and 4 of the drawings.

Figure 3:
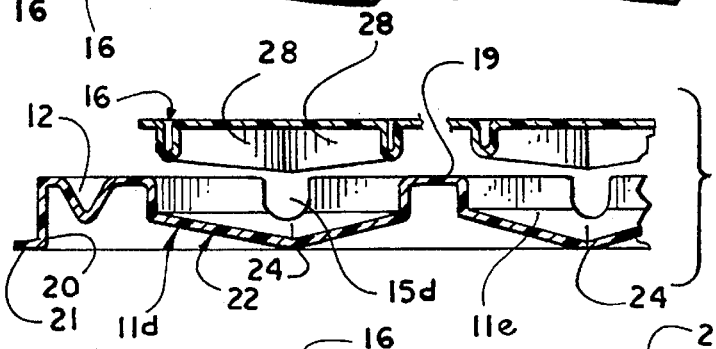
FIG. 3 is an enlarged cross-sectional view taken along the line 3—3 in FIG. 1; and, FIG. 4 is an enlarged cross-sectional view taken along the line 4—4 in FIG. 1.
Figure 4:
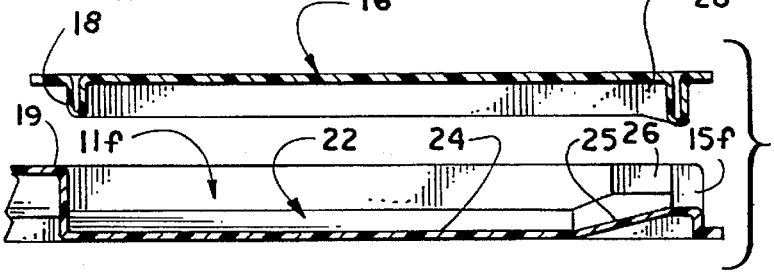

The tray of the present invention is admirably adapted for manufacture by vacuum molding, both the tray 10 and the covers 16 being capable of such manufacture. While other manufacturing methods may of course be used, vacuum forming is relatively inexpensive and is quite adequate for the product of the present invention. In FIGS. 3 and 4 it can be seen that the tray 10 has an upper surface 19, the compartments 11 and design grooves 12 and 14 being defined below the surface 19. The edges of the tray 10 have vertical walls 20 which terminate in an outwardly turned lip 21. The vertical wall 20 therefore supports the surface 19, and the lip 21 provides some rigidity.

The beads often used by bead workers are generally spherical, but may be quite small, around 1 mm in diameter; then, there is a hole diametrically through the bead, so the bead has two flat surfaces. The result is that the bead may roll easily, or may sit on a flat surface and not move. These facts render the beads difficult both to control and to contain. The containers 11 of the present invention are shaped to provide maximum control over such beads. In FIG. 3 it will be observed that the bottom 22 of the compartment 11 is sloped, with the lowest point 24 along the compartment centerline. Further, it is important that the point 24 is on the same plane as the bottom of the lip 21, so the bottom of the container 11 will be directly supported by the supporting surface, rendering the device more stable. The sloped bottom 22 will encourage beads to move towards the center of the compartment. While they may not roll voluntarily, slight shaking of the tray will generally cause the beads to move away from the side walls of the compartment, and this is necessary in order to place the cover 16 on the compartment 11.

The end of the compartment which contains the spout 15 includes a ramp 25 that slopes from the level of the bottom 22 to the level of the spout 15. The ramp provides a smooth transition, which is necessary for the beads to flow from the compartment into a storage container. The angled walls 26 act to funnel the beads into the opening.

The cover 16 has been discussed above briefly, but in FIGS. 2 and 3 the cover is seen in more detail. The rib 18 is defined by a downward return fold of material, so the cover 16 can be easily manufactured by vacuum forming. The rib 18 is so dimensioned that the rib 18 will lie against the walls of the compartment and frictionally hold the cover in place.

The cover 16 has angled rib portions 28 to lie along the angled walls 26 of the compartments 11; and, it is these angled portions that close the open spout to prevent beads from spilling out when the cover is in place. It has been found that the open spout 15 must be rather deep for proper flow of beads, hence the deep spout and ramp 25. This deep spout is then difficult to close. The cover 16 of the present invention has downwardly tapering rib portions 28, so the apex of the rib 18 sufficiently closes the spout 15. This construction is well shown in both FIG. 3 and FIG. 4.

From the above and foregoing discussion, it will be recognized that the present invention provides a very convenient tray for beads and the like. The tray includes a plurality of separate compartments for receiving different types of beads. Further, each compartment has a separate cover, so one or more compartments can be opened for access without opening all the compartments at the same time. This feature allows the beads from each separate compartment to be poured into a storage container if desired. In pouring out the beads, of course the cover 16 must be removed; however, the cover can be turned upside down and placed over the compartment to control the beads, leaving only the necessary opening adjacent to the spout 15.

With all covers in place on the compartments, the tray 10 has a flat upper surface that can be used as a work surface. Furthermore, because of the secure covers 16, the tray of the present invention can be used for permanent storage as well as temporary storage. For permanent storage, the flat upper surfaces are desirable so a plurality of the trays can be stacked.

The design grooves 12 and 14 are convenient for a person to lay out a new design to see how the design looks as contemplated. Also, the completed design can be displayed in one of the design grooves to provide a readily visible pattern for proper assembly of the projects.

It will of course be understood by those skilled in the art that the particular embodiment of the invention here presented is by way of illustration only, and is meant to be in no way restrictive; therefore, numerous changes and modifications may be made, and the full use of equivalents resorted to, without departing from the spirit or scope of the invention as outlined in the appended claims.

I claim:

1. A tray for containing a plurality of beads, said tray defining a plurality of compartments therein, each compartment of said plurality of compartments including a plurality of straight generally vertical walls and a bottom, one end of said compartment comprising angled walls angularly disposed with respect to said plurality of straight walls for defining a funnel, a pour spout between said angled walls, and a plurality of cover means for selectively closing each individual compartment of said plurality of compartments.

2. A tray as claimed in claim 1, said tray including a generally flat surface, vertical walls supporting said flat surface from a supporting surface, each compartment of said plurality of compartments having a total depth generally equal to the height of said vertical wall so that said bottom rests on said supporting surface.

3. A tray as claimed in claim 2, said flat surface having a plurality of sides, said compartments being oriented so that spouts of a first group of compartments are adjacent to a first side of said plurality of sides, and spouts of a second group of compartments are adjacent to a second side of said plurality of sides, and further including at least one design groove adjacent to a side other than said first and second sides.

4. A tray as claimed in claim 2, and further including a ramp extending from said bottom up to said spout.

5. A tray as claimed in claim 2, said bottom being sloped downwardly from said walls of said compartment to a low point, said low point being generally centrally of said compartment.

6. A tray as claimed in claim 1, wherein each cover means of said plurality of cover means comprises a generally flat cover for covering a compartment, and a rib extending from said flat cover and into said compartment adjacent to said generally vertical walls of said compartment for frictionally retaining said cover means.

7. A tray as claimed in claim 6, wherein said rib includes angled portions to be received adjacent to said angled walls, and wherein said rib extends down sufficiently to close said spout.

* * * * *